US005556099A

United States Patent [19]

Mardirosian

[11] Patent Number: 5,556,099

[45] Date of Patent: Sep. 17, 1996

[54] THREE DIMENSIONAL CHESS GAME

[76] Inventor: Roubik Mardirosian, 1133 N. Cedar St., Glendale, Calif. 91207

[21] Appl. No.: 399,189

[22] Filed: Mar. 6, 1995

[51] Int. Cl.[6] ..... A63F 3/02

[52] U.S. Cl. ..... 273/241; 273/261; 273/290

[58] Field of Search ..... 273/236, 241, 273/260, 261, 288, 290

[56] References Cited

U.S. PATENT DOCUMENTS

| | | | |
|---|---|---|---|
| D. 308,549 | 6/1990 | Gengler . | |
| 1,877,154 | 9/1932 | Weaver | 273/241 |
| 3,656,755 | 4/1972 | Thompson . | |
| 3,684,285 | 8/1972 | Kane | 273/241 |
| 3,767,201 | 10/1973 | Harper et al. | 273/241 |
| 3,804,416 | 4/1974 | Jones et al. . | |
| 3,884,474 | 5/1975 | Harper . | |
| 3,897,063 | 7/1975 | Lehwalder . | |
| 3,937,471 | 2/1976 | Brennan | 273/241 |
| 4,504,060 | 3/1985 | Riihiluoma et al. | 273/241 |
| 5,033,751 | 7/1991 | Ching . | |
| 5,112,056 | 5/1992 | Ching | 273/241 |
| 5,193,813 | 3/1993 | Goff . | |
| 5,338,040 | 8/1994 | Cutler | 273/241 |

FOREIGN PATENT DOCUMENTS

| | | | |
|---|---|---|---|
| 2582228 | 11/1986 | France | 273/241 |

*Primary Examiner*—William E. Stoll
*Attorney, Agent, or Firm*—Darby & Darby P.C.

[57] ABSTRACT

A three dimensional chess game is provided, having multiple tiers with role-static pieces and role-altering pieces, the latter pieces being able to assume more than one role during the present game. For example, the role-altering pieces can change roles when they move between the upper and lower tiers, or when they participate in captures, that is, capturing or being captured. Also, the roles of the role-altering pieces may include roles that are similar to and/or different from those of the role-static pieces. To emphasize the change in roles or capacities, the role-altering pieces can be physically altered to reflect or signify their different roles. For example, the Helicopters may have removable upper blade portions positionable on lower portions which resemble the Pawns. Also, for example, the Planes may have removable upper wing portions positionable on lower portions which resemble the Bishops.

16 Claims, 7 Drawing Sheets

THREE DIMENSIONAL CHESS GAME

FIELD OF THE INVENTION

This invention relates to the field of board games. In particular, this invention relates to a three-dimensional board game, for example, a variation of a three-dimensional chess game.

BACKGROUND AND SUMMARY OF THE INVENTION

Board games have been popular throughout history. Even with the recent onset of electronic games, traditional board games, such as chess and checkers, have retained their popularity.

Chess and checkers have been in existence for over thousands of years, dating back to ancient Egypt. The rules of the games have varied with time, but a set of standardized rules has evolved for the game of chess, as we know it today. These standardized rules provide for 32 pieces in total, having two colors, typically, 16 dark pieces and 16 light pieces. These pieces are assigned different roles or capacities which define various movements (for advancement and/or capture) for the game of chess.

Just as there have been numerous variations of chess prior to the establishment of the standardized rules, there have been numerous variations since. Some of the more recent variations include the use of a single board or level, with skewed squares, such as that of "Doubles Chess"™, a chess game for four players, and the use of squares forming a non-rectangular playing area, such as that of "Chess4"™, a chess game manufactured by WOW Toys, Inc., also for four players. There have also been variations expanding the traditional game of chess for two players from two-dimensions (a single tier or level) to three-dimensions (multiple tiers or levels).

The expansion to three dimensions, while increasing the degree of challenge, often significantly complicates the rules of play. For example, where current three-dimensional board and chess games enable pieces to move between tiers or levels, the number of available offensive and defensive movements are often increased dramatically. Whereas a player of two-dimensional chess has to consider offensive and defensive movements only on a single tier, a player of three-dimensional chess has to also consider offensive and defensive movements on as well as between the multiple tiers. These more complicated board and chess games are discussed in U.S. Pat. Nos. 5,033,751 and 5,112,056 issued to Ching, 5,193,813 issued to Goff, 5,338,040 issued to Cutler. A three-tiered chess game is also disclosed in "Space Chess"™, a chess game manufactured by Chessex in Berkeley, Calif.

Conventional board games employ traditional chess movements. A need exists for games with new pieces and movements to make the game more challenging or interesting and to modernize the game using contemporary elements of warfare.

In one preferred embodiment, the present game provides two tiers, the upper tier being smaller than the lower tier. For example, the upper tier may be a six square by six square board and the lower tier may be an eight square by eight square board. The upper tier may be mounted onto one or more support columns extending vertically from the lower tier.

Furthermore, the present game provides role-static pieces and role-altering pieces, the latter pieces being able to assume more than one role during the present game. For example, the role-altering pieces can change roles when they move between the upper and lower tiers, or when they participate captures, that is, capturing or being captured. Also, the roles of the role-altering pieces may include roles that are similar to and/or different from those of the role-static pieces.

In one preferred embodiment, the role-static pieces are Kings, Queens, Rooks and Knights. For purposes of facilitating discussion herein, Pawns are also referred to as role-static pieces, except that, in one preferred embodiment, the Pawns can be promoted to Kings, Queens, Rooks, Knights or Bishops when the Pawns have moved completely across the lower tier.

Also, in one preferred embodiment, the role-altering pieces are modern elements of warfare, such as Helicopters and Planes, the Helicopters being able to assume the role of either the Planes or the Pawns, and the Planes being able to assume the role of the Bishops. For example, a Helicopter is limited to movement on the upper tier unless it captures an opponent's piece directly below on the lower tier. After the capture, the Helicopter becomes a Pawn and is limited to movement on the lower tier as the Pawn. However, if a Helicopter remains on the upper tier and travels completely across the upper tier, it has the option of either (i) becoming a Plane and still remain on the upper tier or (ii) moving directly down to the lower tier (without capturing) and becoming a Pawn.

As concerning the Planes, a Plane is limited to movement on the upper tier unless it captures an opponent's piece directly below on the lower tier. After the capture, the Plane becomes a Bishop on the lower tier and is limited to movement on the lower tier as the Bishop.

To emphasize the change in roles or capacities, the role-altering pieces can be physically altered to reflect or signify their different roles. For example, the Helicopters may have removable upper blade portions positionable on lower portions which resemble the Pawns. Also, for example, the Planes may have removable upper wing portions positionable on lower portions which resemble the Bishops.

In one preferred embodiment, the present game permits or allows only selective pieces to travel between tiers, for example, the King, Queen, Rook, Helicopter and Plane. And, of these pieces, the role-static pieces can travel between tiers without changing their roles.

Also, in one preferred embodiment, the present game allows only selective pieces to return to their original tier once they have changed tiers. For example, only the Queen and the Rook may return to the lower tier once they have travelled to the upper tier, whereas the Helicopters and the Planes cannot return to the upper tier after they have moved to the lower tier.

As such, the present game provides increased challenges while maintaining the rules of play at an acceptable level of complexity. The present game provides a range of variations which are substantially easy to learn and master. The range of variations may be determined by the players themselves, by selecting when and where to change the roles of the role-altering pieces. For example, where the role-altering pieces have roles different from the role-static pieces, the present game can be relatively more complex and challenging. Where the role-altering pieces have roles similar to the role-static pieces, the present game can be easier to play and less complex. Accordingly, for less-experienced players who wish to maintain the rules of play at a comfortable level, the game can be played with a limited number of different roles, though the increased number of pieces will increase the degree of challenge. For more-experienced players who wish to elevate the rules of play and substantially increase the degree of challenge, the game can be played with a greater number of different roles with increased number of pieces. These, as well as other features of the invention, will become apparent from the detailed description which follows, considered together with the appended drawings.

DESCRIPTIONS OF THE DRAWINGS

In the drawings, which constitute a part of this specification, preferred embodiments demonstrating various objects and features hereof are set forth as follows:

FIG. 1 is a perspective view of the present game with playing pieces in their respective starting positions, in accordance with one preferred embodiment;

FIG. 1*a* is a diagrammatic view of various movements of the playing pieces on upper and lower tiers;

FIG. 2 is an exploded view of the upper tier and lower tier without the playing pieces;

FIGS. 3 and 3*a* are diagrammatic views of the movements of the King, its representative playing piece and symbol;

FIGS. 4 and 4*a* are diagrammatic views of the movements of the Queen, its representative playing piece and symbol;

FIGS. 5 and 5*a* are diagrammatic views of the movements of the Rook, its representative playing piece and symbol;

DESCRIPTION OF THE ILLUSTRATIVE EMBODIMENTS

As indicated above, detailed illustrative embodiments are disclosed herein. However, games for accomplishing the objectives of the present invention may be detailed quite differently from the disclosed embodiments. Consequently, specific structural and functional details disclosed herein are merely representative; yet, in that regard, they are deemed to afford the best embodiments for purposes of disclosure and to provide a basis for the claims herein which define the scope of the present invention.

Figure 1:
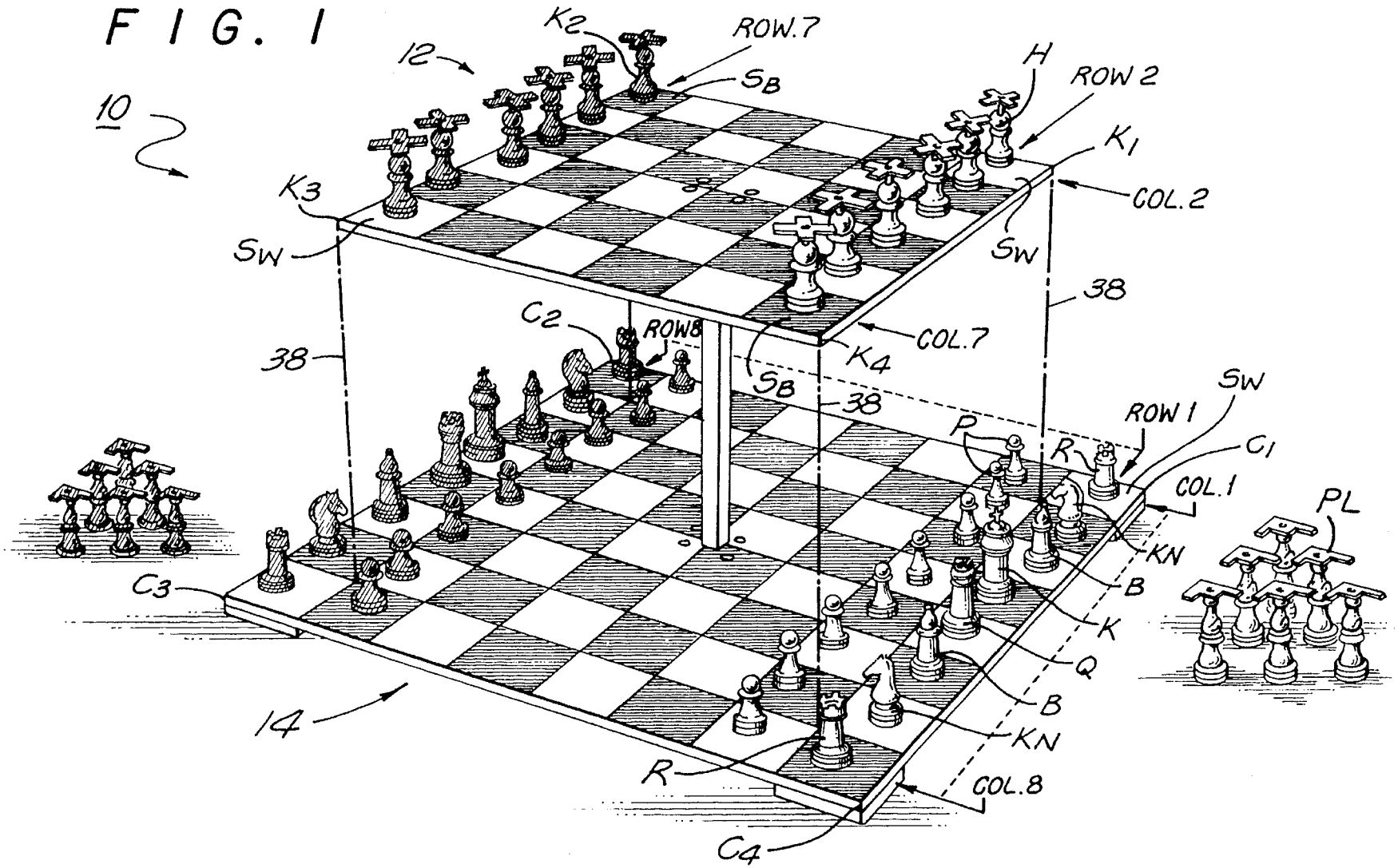

Referring to FIG. 1, a three-dimensional board game 10 is provided. In accordance with the present invention, the game 10 offers a multi-tiered board game challenging to most chess players.

In one preferred embodiment, the game 10 provides an upper tier 12 and a lower tier 14. Each of the tiers 12 and 14 is substantially rectangular in shape with corners C and K, respectively. Each of the tiers 12 and 14 has sections, for example, squares S, which may be of a dark color and a light color, for example, black squares $S_B$ and white squares $S_W$.

The tiers 12 and 14 may be constructed of glass or synthetic polymeric materials to provide translucency in the light color squares, yet provide sufficient rigidity across the tiers 12 and 14. In one preferred embodiment, the tiers 12 and 14 are constructed of an acrylic blend material. As such, the squares S of the lower tier 14 can be seen through the light colored, or white squares $S_W$ of the upper tier 12.

In one preferred embodiment, the lower tier 14 has 64 squares in total, 32 in black and 32 in white, arranged in a formation of eight squares by eight squares. The black squares $S_B$ and the white squares $S_W$ are arranged such that no two squares of the same color are immediately adjacent of each other at their sides. The squares S on the lower tier 14 are arranged such that two of the white squares $S_W$ diagonally oppose each other from two of the corners $C_1$ and $C_3$ of the lower tier 14. Likewise, two of the black squares $S_B$ diagonally oppose each other from another two of the corners $C_2$ and $C_4$ of the lower tier 14.

Moreover, in one preferred embodiment, the upper tier 12 has 36 squares in total, 18 in black and 18 in white, arranged in a formation of six squares by six squares. These squares are also arranged in alternating black and white colors. Like the squares S on the lower tier 14, the squares S on upper tier 12 are arranged such that two of the white squares $S_W$ diagonally oppose each other from two of the corners $K_1$ and $K_3$, while two of the black squares $S_B$ diagonally oppose each other from another two of the corners $K_2$ and $K_4$.

Figure 2:
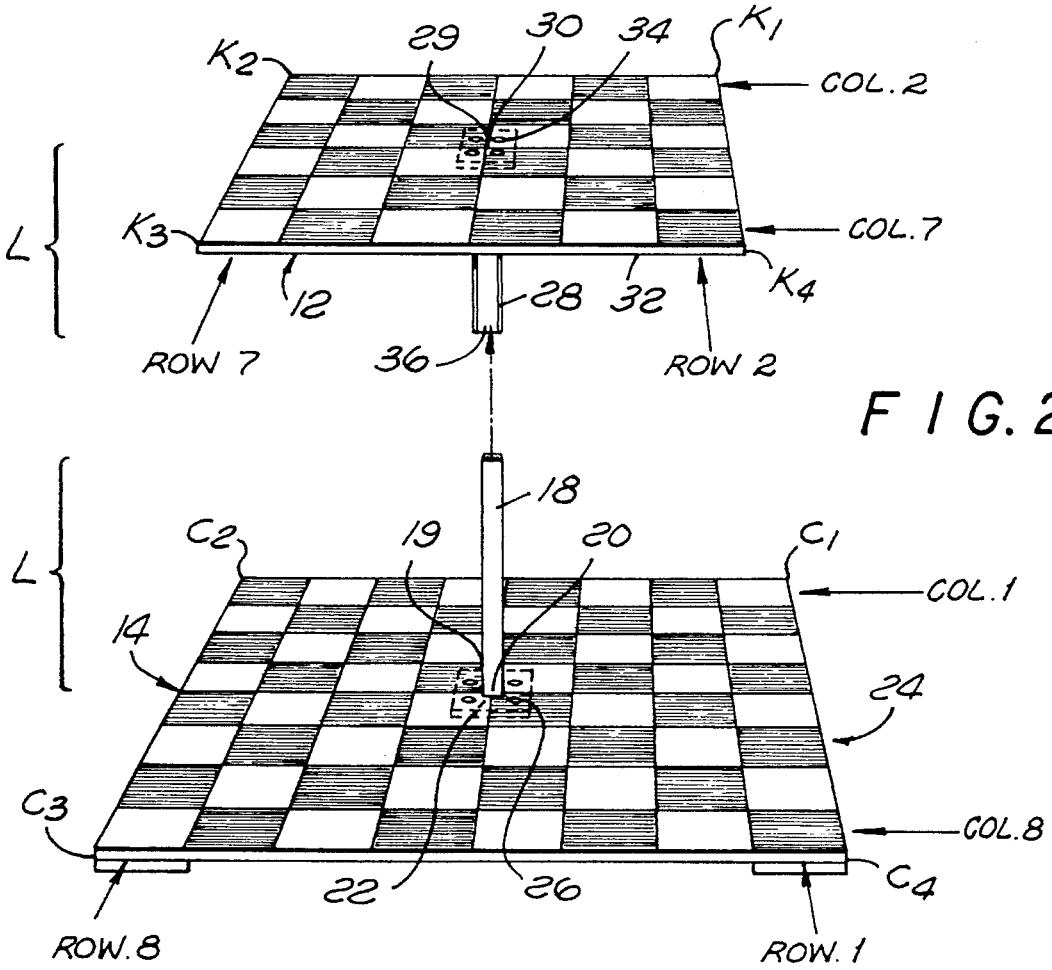

Referring to FIG. 2, the tiers 12 and 14 define parallel planes. In one preferred embodiment, the lower tier 14 provides for a support column 18 which extends vertically upward through an opening 19 in a center region 20 of the tier 14. Although the column 18 may be constructed of any material providing sufficient support, such as wood, steel, or the like, it is constructed of stainless steel in one preferred embodiment. The column 18 has a length L and a base 22 which is rigidly, but removably, affixed to an underside 24 of the lower tier 14, by means of screws 26, nails, or the like.

The upper tier 12 also provides for a support column 28 extending vertically downward from a center region 29 of the tier 12. The column 28 has the length L and a base 30 which is rigidly, but removably, affixed to an underside 32 of the upper tier 12, by means of screws 34, nails, or the like.

The column 28 is constructed similarly to the column 18; however, the column 28 is configured to provide a hollow portion 36 extending along its length L such that the column 28 accommodates and is able to receive the column 18 when the upper tier 12 is placed above the lower tier 14.

Referring to FIGS. 1 and 2, since the columns 18 and 28 are both affixed to the center regions 20 and 29, respectively, of the tiers 12 and 14, the two center regions 20 and 29 are substantially in vertical linear alignment. As shown by lines 38, the white squares $S_W$ of the upper tier 12 are in vertical alignment with the white squares $S_W$ of the lower tier 14; likewise, the black squares $S_B$ of the upper tier 12 are in vertical alignment with the black squares $S_B$ of the lower tier 14.

In view of the above, where the game 10 is assembled, the two columns 18 and 28 engage each other for supporting the two tiers 12 and 14 as parallel planes. Where the game 10 is unassembled, the tiers 12 and 14, and the columns 18 and 28 are all detached from each other to facilitate convenient storage requiring minimal space.

Still referring to FIGS. 1 and 2, the tiers 12 and 14 are positioned relative to two players or opponents, a Black Side (shaded) and a White Side (unshaded), such that the corners $C_1$, $C_4$, $K_1$ and $K_4$ are nearest to the White Side and the corners $C_2$, $C_3$, $K_2$ and $K_3$ are nearest to the Black Side. For reference, the squares S extending between the corners $C_1$ to $C_4$ of the lower tier 14 are collectively designated as Row 1 and the squares S extending between the corners $C_2$ and $C_3$ are collectively designated as Row 8. Rows 2–7 extend sequentially between the Rows 1 and 8.

Also on the lower tier 14, the squares S extending between the corners $C_1$ and $C_2$ are collectively designated as Column 1, and the squares S extending between the corners $C_4$ and $C_3$ are collectively designated as Column 8. Columns 2–7 extend sequentially between the Columns 1 and 8.

With respect to the upper tier 12, the squares S are also collectively designated in Rows and Columns. Because the upper tier 12 is six squares by six squares and substantially centrally aligned with the lower tier 14, the Rows and Columns of the upper tier 12 are also designated as Rows 2–7 and Columns 2–7 to coincide with the Rows 2–7 and Columns 2–7 of the lower tier 14. Accordingly, each of the squares S in the game 10 can be designated by the tier (upper or lower) the Row and the Column.

Referring to FIG. 1, the game 10 allows for fifty-six playing pieces in total, thirty-eight for each player, as listed below.

| Light Playing Pieces (No. of Pieces and Role) | Dark Playing Pieces (No. of Pieces and Role) |
|---|---|
| 1 King (K) | 1 King (K) |
| 1 Queen (Q) | 1 Queen (Q) |
| 2 Bishops (B) | 2 Bishops (3) |
| 2 Knights (K) | 2 Knights (K) |
| 2 Rooks (R) | 2 Rooks (R) |
| 8 Pawns (P) | 8 Pawns (P) |
| 6 Helicopters (H) | 6 Helicopters (H) |
| 6 Planes (PL) | 6 Planes (PL) |
| 28 Light Pieces | 28 Dark Pieces |

Although only the game 10 allows for the fifty-six playing pieces, the game 10 commences with only forty-four pieces, as shown on the tiers 12 and 14 in FIG. 1. That is, with the exception of the twelve Planes, the remaining forty-four pieces are positioned on the tiers 12 and 14. For example, on the lower tier 14, on Rows 1 and 8, the players have their respective pairs of Rooks, Knights, Bishops, and their respective King, and Queen positioned on separate squares S, as shown in FIG. 1. On Rows 2 and 7 of the lower tier 14, the players have their respective eight Pawns positioned on separate squares S. On the upper tier 12, on Rows 2 and 7, the players have their respective six Helicopters on separate squares S, as shown in FIG. 1.

The playing pieces of the players are arranged similarly, except that for both players, each Queen is positioned on a square S of the player's own color. That is, the White Queen is on one of the white squares $S_W$ on the lower tier 14 (Row 1, Column 5) and the Black Queen is on one of the black squares $S_B$ on the lower tier 14 (Row 8, Column 5). Accordingly, the White King is to the immediate right of the White Side on the square to the right and the Black King is to the immediate left of the Black Queen on the square to the left.

To reiterate, at the commencement of the game 10, the Planes do not have starting positions on any of the squares S of either of the tiers 12 and 14. As explained below in further detail, the Planes will participate only as selected by the players when they have made certain movements with other playing pieces, for example, their respective Helicopters.

To commence the game, the White Side makes a first move, followed by a move by the Black Side. The two Sides then continue, alternating in turn to make their moves. The following discusses the movements (advancing and/or capturing) of the pieces on the tiers 12 and/or 14 of the game 10. In particular, the movements occur as a player moves a playing piece of his own color from a square S to a different square S, on either the same tier or a different tier.

Generally, a movement of a piece can "advance" the piece from one square to another square. In this sense, "advancing" a piece connotes no specific direction of that piece relative to the tiers 12 and 14; it simply entails a change in the square S occupied by the piece, not displacing or "capturing" another piece. As for capturing, a piece "captures" an opponent's piece on another square by displacing the opponent's piece (the captured piece) on that square. For certain pieces, for example, the Pawns, the Helicopters, and the Planes, their respective advancing movements differ from their respective capturing movements. In one preferred embodiment, once a playing piece is captured, it is removed from the game 10. However, as provided by the present game, other preferred embodiments of the game 10 may provide for the captured piece and to return to a starting position and continue participation in the game in a demoted role. Moreover, other preferred embodiments of the game 10 may provide for the capturing piece to continue participation in the game in a promoted role.

Also in the game 10, certain playing pieces may be blocked from movement by the presence of other pieces, either of the same color or the other color.

Figure 1A:
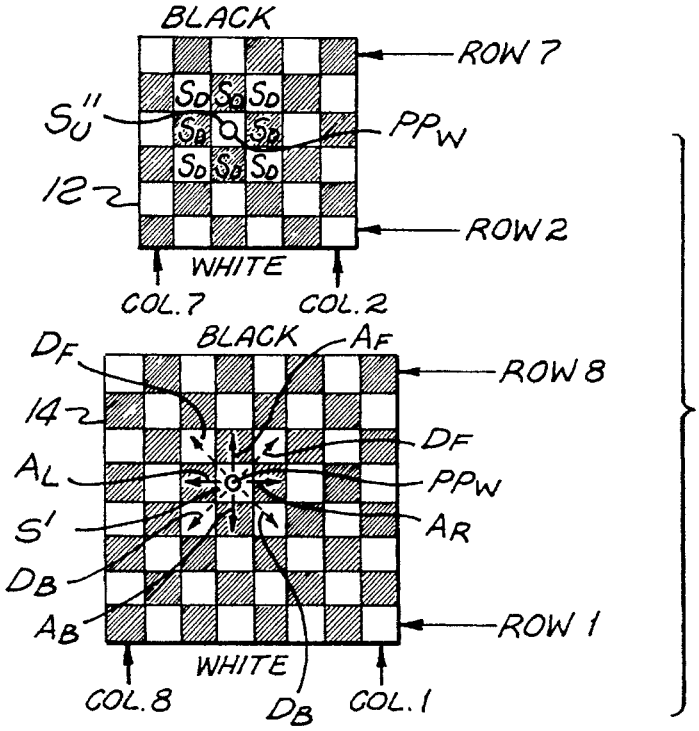

Referring to FIG. 1*a*, the following terminology will be used to describe movements of a White playing piece $PP_W$ from a square S' on the lower tier 14 in the game 10. Namely, movements through a side of the square S' are indicated by solid arrows. The solid arrows represent movements as follows:

$A_F$=forward (toward the opponent, Black Side)

$A_B$=backward (away from the opponent)

$A_L$=sideways to the left $A_R$=sideways to the right

These movements, depending on the particular playing piece, may entail movements by one or more squares, all of which alternate in color.

Movement through a corner of the square S' on the lower tier 14 are indicated by broken arrows. The broken arrows represent diagonal movements as follows:

$D_F$=diagonally forward (toward the opponent)

$D_B$=diagonally backward (away from the opponent)

These movements, depending on the particular playing piece, may entail movements of one or more squares, all of which are of the same color.

Movements between the tiers 12 and 14 are also available in the game 10. They may be directly upward or downward, or diagonal staircasing. Where there are multiple tiers, upwardly and downwardly movements involve changing the tier position while maintaining the Row and Column positions. Thus, the upwardly and downwardly movements entail movements by one or more squares, all of which are of the same color. For example, the playing piece $PP_W$ in moving upward from the lower tier 14 to the upper tier 12 would move from the square S' on the lower tier 14 to a square $S_U$ on the upper tier 12.

As for diagonal staircasing between multiple tiers, this movement involves (i) changing the tier position by a certain quantity and (ii) changing either one or both of the Row and/or the Column by that same quantity. In other words, the staircasing movement may be described as starting from $Tier_i$, $Row_i$, $Column_i$ and moving to (i) $Tier_{i+x}$, $Row_{i+x}$ and $Column_i$; (ii) $Tier_{i+x}$, $Row_i$ and $Column_{i+x}$; or (iii) $Tier_{i+x}$, $Row_{i+x}$ and $Column_{i+x}$, where x is a positive or negative integer. Thus, depending on the particular staircase on which the playing piece moves, the squares may be either all of the same color, or all of alternating colors. For example, the playing piece $PP_W$ in diagonally staircasing from the lower tier 14 to the upper tier 12 could move from the square S' on the lower tier to any one of squares $S_D$ on the upper tier 12.

In one preferred embodiment of the game 10, diagonal staircasing is not provided. Thus, the playing piece PP can move only directly up and down when moving between the tiers 12 and 14, that is, between the squares S' and $S_U$. However, it is stressed that limiting the movements between the tiers 12 and 14 as such is but one variation of the game 10.

With these definitions of movements, the following describes the movements of each playing piece.

THE KING

Figure 3:
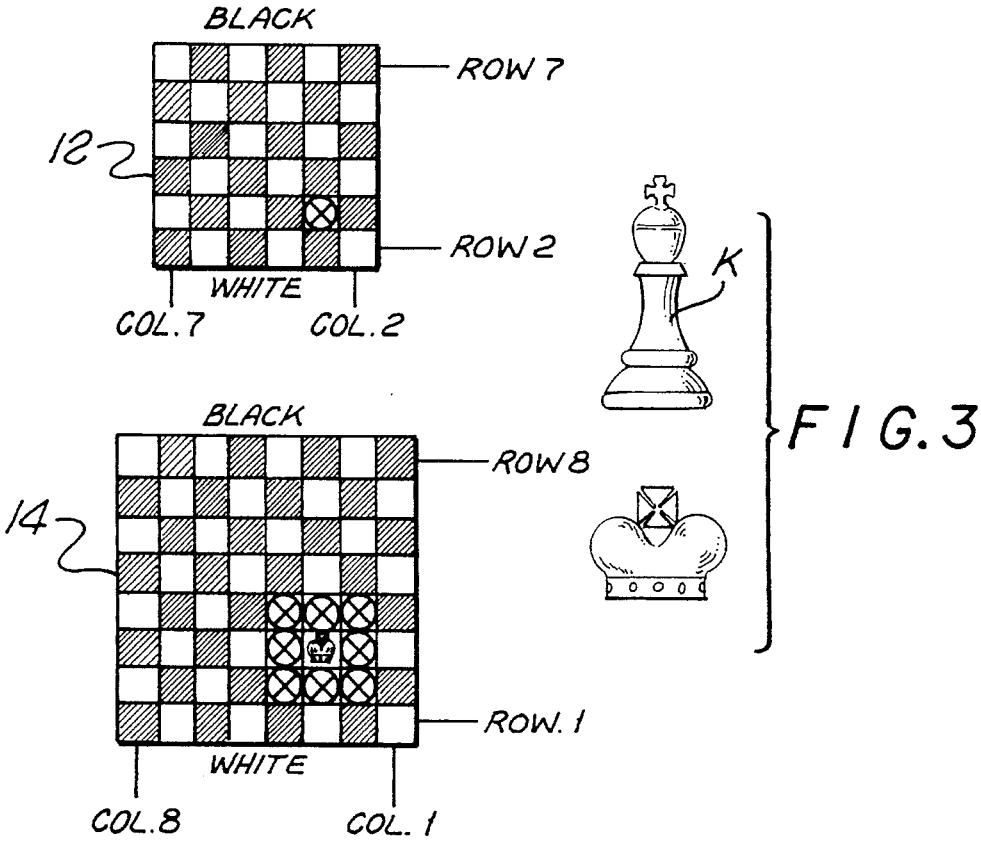
Figure 3A:
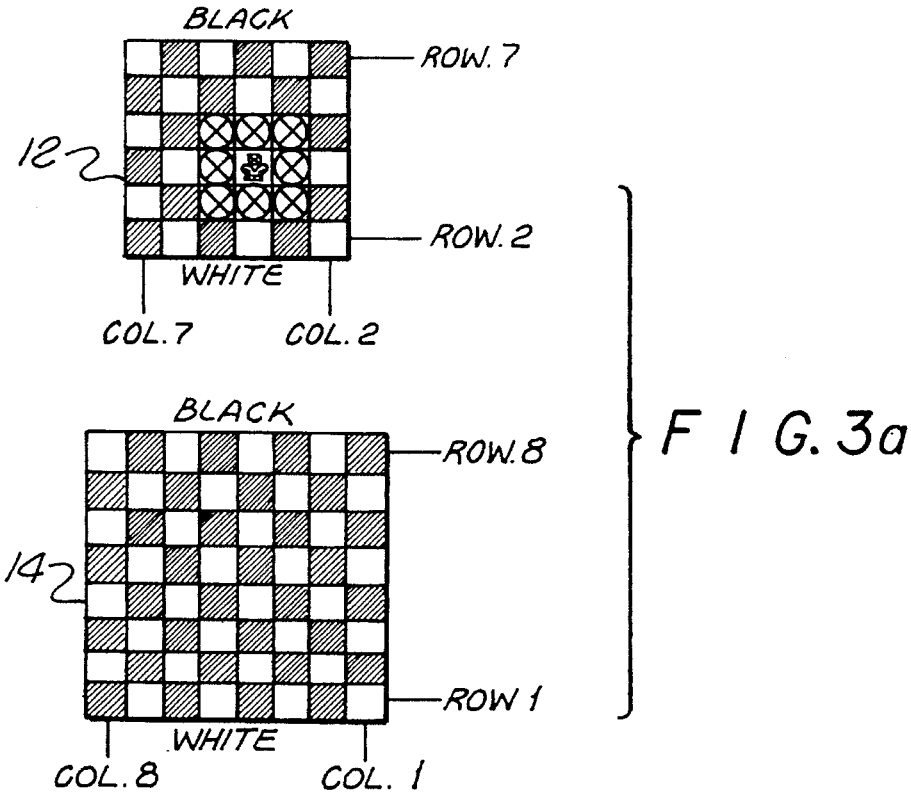

Referring to FIGS. 3 and 3*a* showing one preferred embodiment, the King moves one square at a time. For the King, as well as other playing pieces, the squares S marked by an "X" symbol indicate permitted advancing movements and the squares S marked by an "O" symbol indicated permitted capturing movements. Those squares that are jointly marked by the "X" and the "O" symbols indicate both permitted advancing and/or capturing movements. As discussed in detail later, certain playing pieces, for example, the Pawns, the Helicopters, and the Planes, have separate advancing and capturing movements.

While on either of the tiers 12 and 14, the King can move forward, backward, right, left, or diagonally. However, the King can only move up from the lower tier 14 to the upper tier 12. As shown in FIG. 3*a*, once the King is on the upper tier 12, it cannot return to the lower tier 14.

The King can capture any piece of the opponent that occupies any square S to which the King can move. The King can be blocked by its own pieces or its opponent's pieces as it cannot jump or leap over any other pieces, whether of its own color or of the other color.

THE QUEEN

Figure 4:
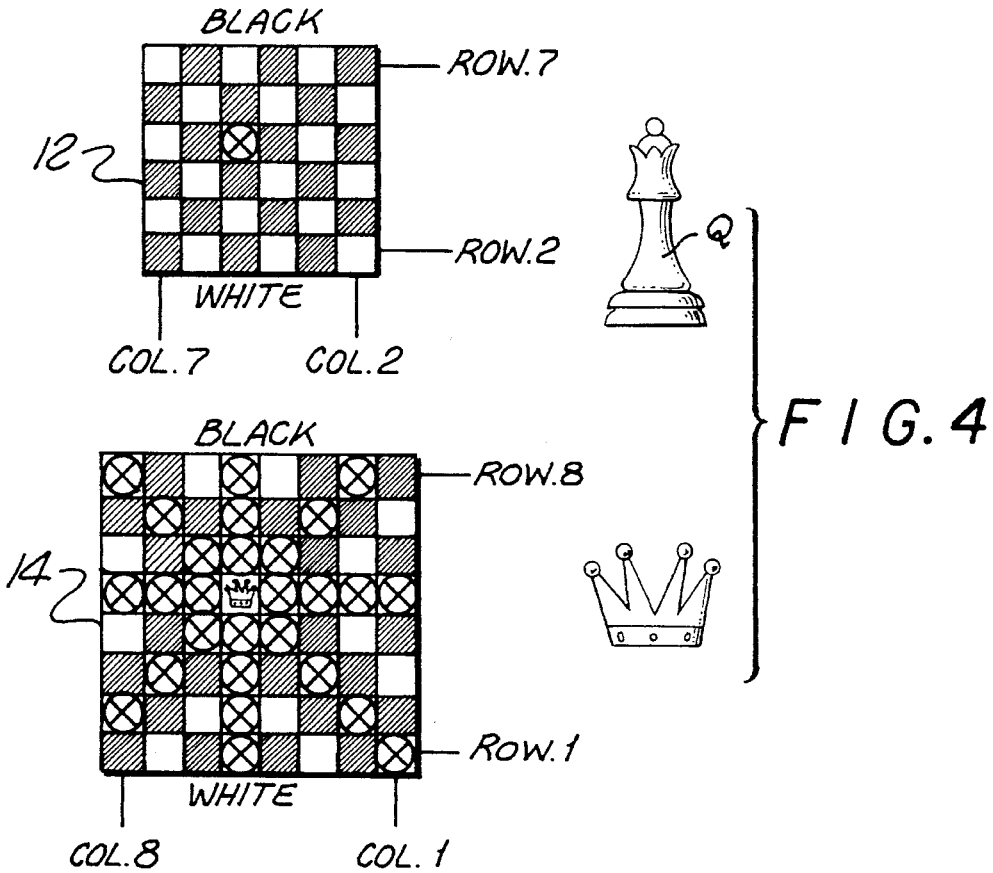
Figure 4A:
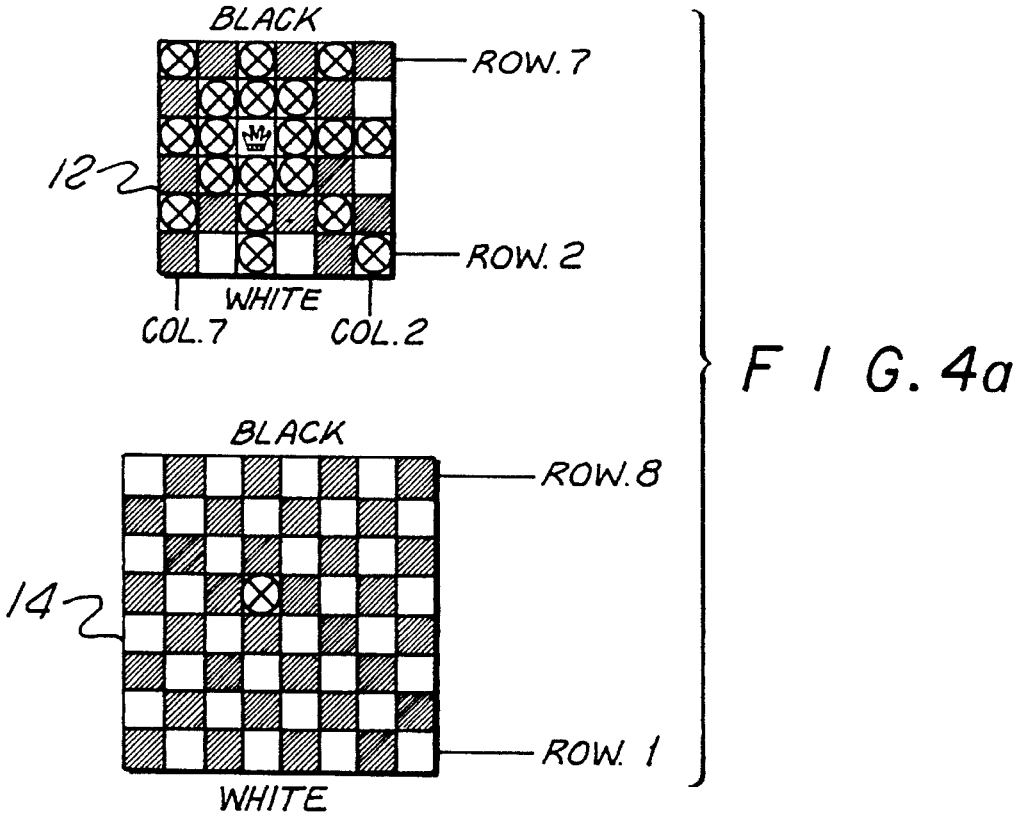

In one preferred embodiment as shown in FIGS. 4 and 4*a*, the Queen can move forward, backward, right, left, diagonally, up or down, and it can move any number of squares S at one time. The Queen moving between the tiers 12 and 14 constitutes one move. The Queen has the same range of movement on either the tier 12 or 14. The Queen can displace and capture any piece of the other color that is within its movement range. However, the Queen may also be blocked as it cannot move to any square S occupied by its own pieces or leap over its own pieces or the opponent's pieces.

THE ROOK

Figure 5:
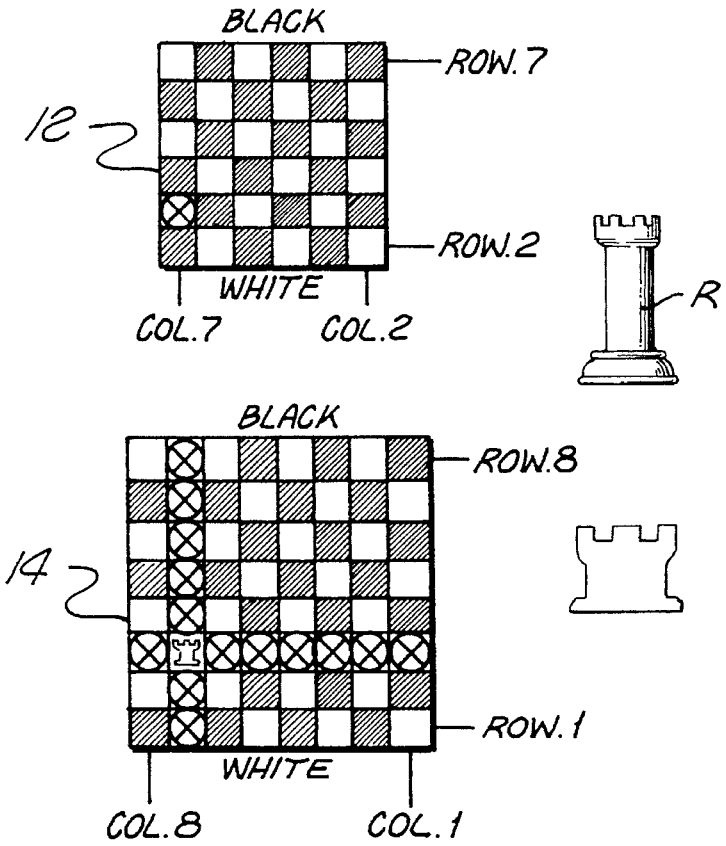
Figure 5A:
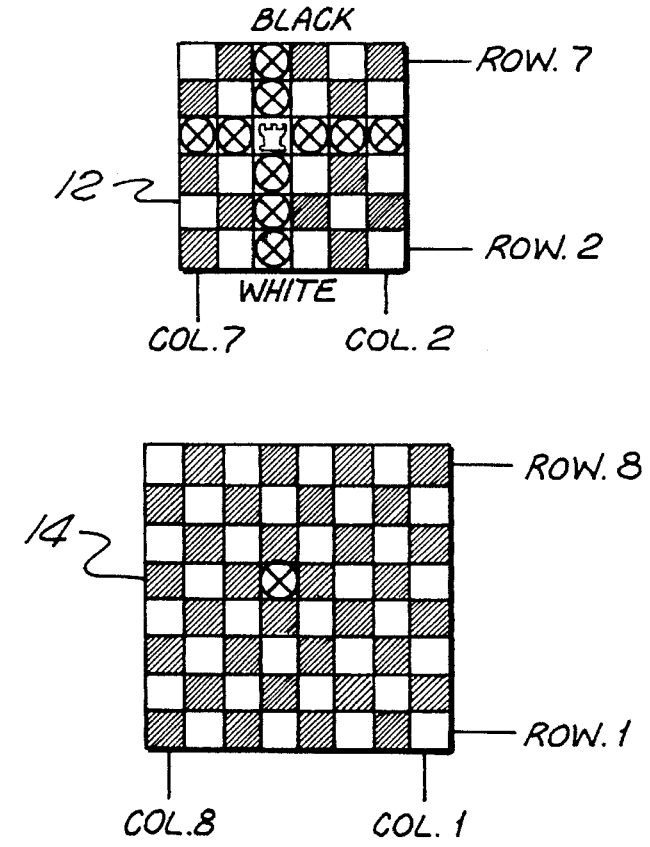

Referring to FIGS. 5 and 5*a* showing one preferred embodiment, the Rook cannot move diagonally, but can move forward, backward, right or left, along a row R or a column C, in any number of squares S. The Rook may move up and down between the tiers 12 and 14, each of such up or down movement constituting one movement. The Rook has the movements shown in FIG. 5 while on the lower tier 14 and the movements shown in FIG. 5*a* while on the upper tier 12. The Rook cannot displace any piece of its own color and it cannot leap over any other pieces, its own color or otherwise. The Rook can capture any of the opponent's pieces occupying a square onto which the Rook can move.

THE BISHOP

Figure 6:
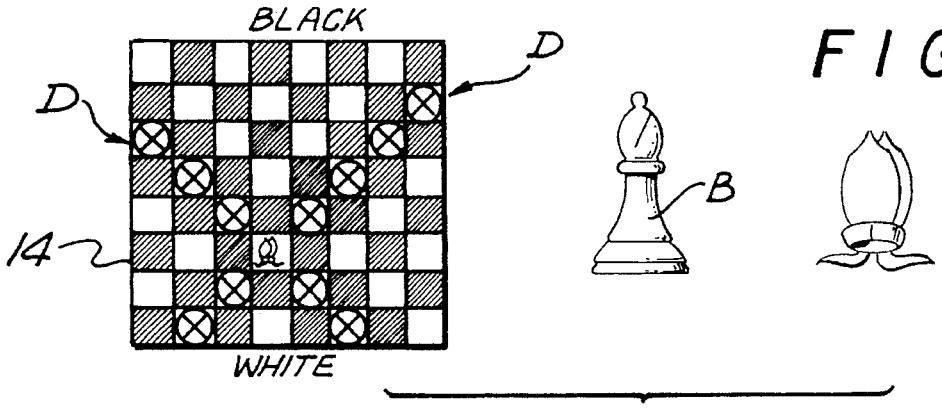
FIG. 6 is a diagrammatic view of the movements of the Bishop, its representative playing piece and symbol.

As shown in FIG. 6, the Bishop in one preferred embodiment can move diagonally only, but it can move any number of squares S in one move. Thus, the white Bishop can move only on the white squares $S_W$ and the black Bishop only on the black squares $S_B$. The Bishop can neither displace any of its own pieces nor leap over any other pieces of its own color or otherwise. The Bishop captures any of the opponent's pieces occupying a square onto which the Bishop can move. Also, the Bishop remains on the lower tier 14; it cannot move to the upper tier 12 in the one preferred embodiment.

THE KNIGHT

Figure 7:
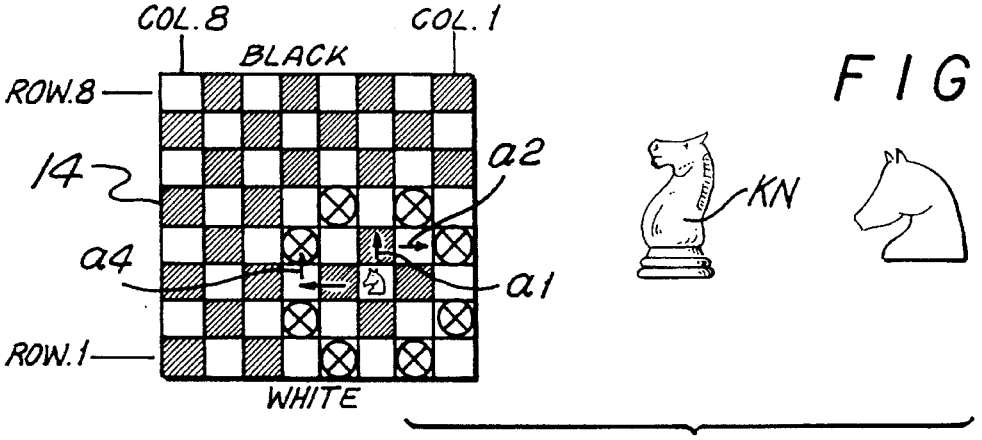
FIG. 7 is a diagrammatic view of the movements of the Knight, its representative playing piece and symbol.

The Knight always moves to a square S of the opposite color in the preferred embodiment. Referring to FIG. 7, the Knight starts from a white square $S_W$ and may move to only black squares $S_B$, all of which are of a distance from the first white square $S_W$. The movement of the Knight may be described as either (i) moving one square through a side to an adjacent Row (arrow $a_1$) and moving two squares through two sides to two Columns over (arrow $a_2$), or (ii) moving two squares through two sides to two Columns over (arrow $a_3$) and through a side to an adjacent Row (arrow $a_4$). In other words, the two movements may be described as starting from $Row_i$, $Column_i$ and moving to (i) $Row_{i+1}$ or $Row_{i-1}$, and further moving to $Column_{i+2}$ or $Column_{i-2}$; or (ii) $Row_{i+2}$ or $Row_{i-2}$, and further moving to $Column_{i+1}$ or $Column_{i-1}$.

Unlike the other playing pieces, the Knight can leap over its own pieces or the opponent's pieces. However, the Knight cannot displace it own pieces, but can capture any of the opponent's pieces occupying a square onto which it can move. The Knight, too, must remain on the lower tier 14 as it cannot travel up to the upper tier 12 in the one preferred embodiment.

THE PAWN

Figure 8:
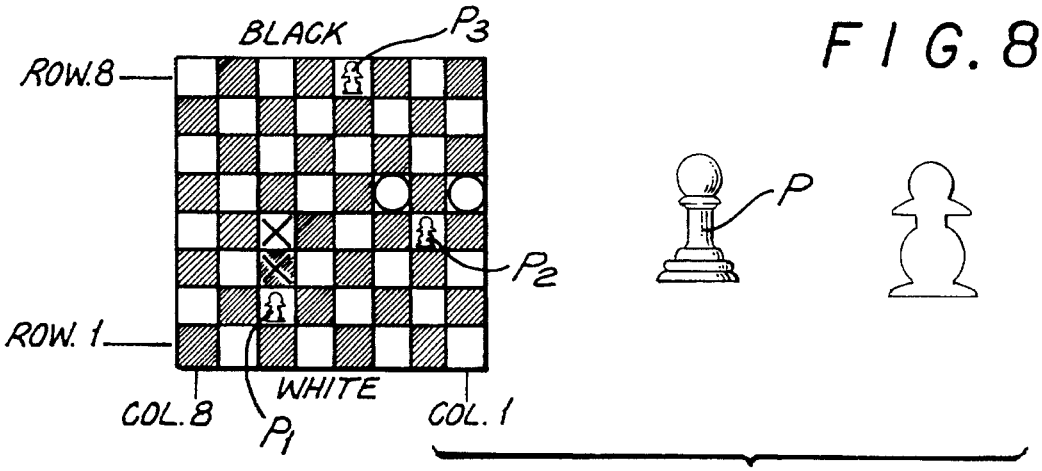
FIG. 8 is a diagrammatic view of the movements of the Pawn, its representative playing piece and symbol.

In one preferred embodiment, the Pawn has separate movements, one for advancing and another for capturing. At the commencement of the game (FIG. 1), the Pawns are positioned on Row 2 (White Pawns) and Row 7 (Black Pawns), in separate Columns (Columns 1–8), all on the lower tier 14. As shown in FIG. 8, the Pawns can advance only forward, that is, remaining in each of their respective columns. Only where a Pawn $P_1$ is making its first move in the game 10, the Pawn $P_1$ may advance by either one square S or two squares S, as shown by the "X." After making its first move in the game 10, the Pawn $P_1$ is limited to advancing forward (remaining within its Column) by one square S only. To capture an opponent's piece, a Pawn $P_2$ can move diagonally toward the opponent's side by one square S, as shown by the "O," moving into an adjacent Column.

If a Pawn moves completely across the lower tier 14, via advancement or capture, prior to the completion of the game 10 (e.g., a White Pawn moving to Row 8, or a Black Pawn moving to Row 1) that Pawn may assume the role of any other role-static piece of its own color. As shown in FIG. 8, a White Pawn $P_3$ upon reaching the Row 8 may at the selection of the White Side assume the role of a White Queen, for example, thus the White Pawn P3 becoming a White Pawn-Queen. This White Pawn-Queen is now permitted to have movements similar to those of the White Queen.

THE HELICOPTER

In one preferred embodiment, the Helicopter also has two separate movements, one for advancing and another for capturing. At the commencement of the game (FIG. 1), the Helicopters are positioned on the upper tier 12, on Row 2 (White Helicopters) and Row 7 (Black Helicopters), in separate Columns (Columns 2–7).

Figure 9:
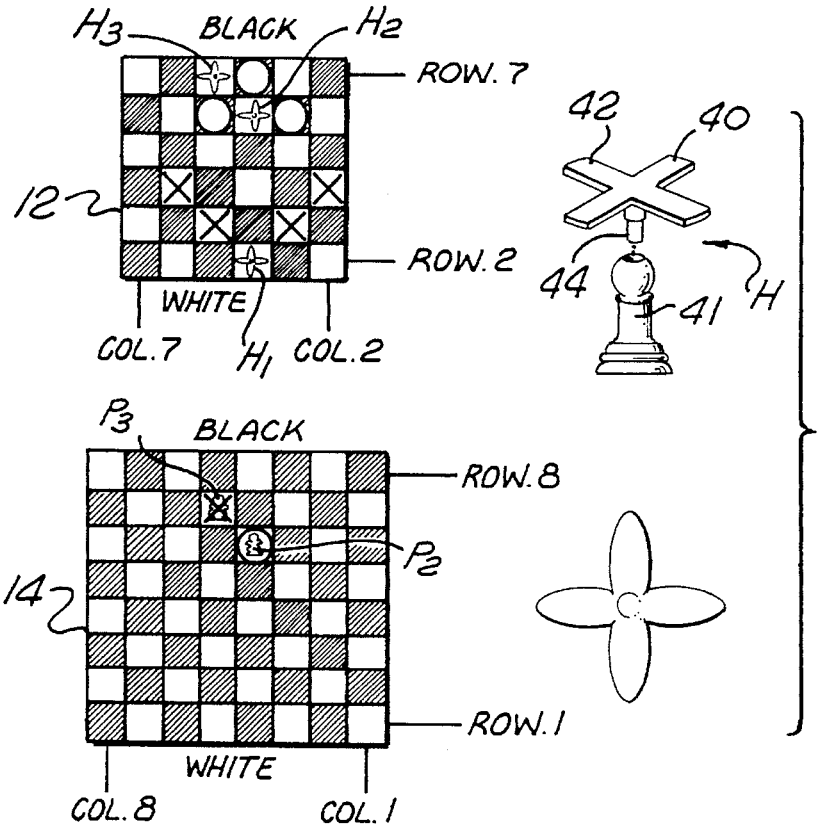
FIG. 9 is a diagrammatic view of the movements of the Helicopter, its representative playing piece and symbol.

As shown in FIG. 9, the Helicopters can advance diagonally toward the opponent's side on the upper tier 12. Only if the Helicopter is making its first move in the game it can move diagonally toward the opponent's side by either one or two squares. All other advancing movements by the Helicopter on the upper tier 12 are diagonally toward the opponent by only one square. For example, a White Helicopter H, can advance diagonally forward by one or two squares on its first move, as indicated by the "X" symbols on the upper tier 12.

As for capturing, the Helicopters can capture an opponent's piece occupying one square forward, right or left on the tier 12, or the square directly below on the lower tier 14. For example, a Helicopter $H_2$ can capture an opponent's piece positioned on the squares S indicated by the "O" symbols on the tiers 12 and 14. If the Helicopter $H_2$ captures an opponent's piece directly below on the lower tier 14, the Helicopter $H_2$ becomes a Pawn $P_2$ on the lower tier 14. Thus, the Pawn $P_2$ is an additional Pawn having movements of the Pawn as described in preceding paragraphs. Accordingly, the Pawn $P_2$ is limited to movement on the lower tier 14 for the remainder of the game 10.

The Helicopter can also alter or change roles without capturing. In one preferred embodiment, if the Helicopters remain on the upper tier 12 and move completely across the upper tier 12 prior to the completion of the game 10 (e.g., White Helicopters moving to Row 7, or Black Helicopters moving to Row 2) those Helicopters have two optional movements, one to remain on the upper tier 12 and another to move to the lower tier 14. As to the former optional movement, it is discussed in detail below in the section regarding the Planes. As to the latter optional movement, the Helicopters change into Pawns when they move directly down to the lower tier 14. For example, a Helicopter $H_3$ having moved completely across the upper tier 12 can, as one optional movement, move to the square directly below on lower tier 14 and change into a Pawn $P_3$ shown superimposed on an "X" on the lower tier 14.

To emphasize the change of roles from the Helicopter to the Pawn, the Helicopter H shown in FIG. 9 provides an upper blade portion 40 removable from a lower portion 41. In one preferred embodiment, the lower portion 41 resembles the Pawn. and the upper blade portion 40 has a plurality of horizontal intersecting blades 42 and a stem 44 extending vertically downward from the intersection of the blades 42. To receive the stem 44, the lower portion 41 defines a hole 46 into which the stem 44 can be inserted. Accordingly, where the Helicopter H is on the upper tier 12, the upper blade portion 40 is positioned on the lower portion 41 to signify the role of the Helicopter H. Where the Helicopter H has moved to the lower tier 14 and assumed the role of the Pawn, the upper blade portion 40 is removed to signify the role of the additional Pawn.

THE PLANE

Figure 10:
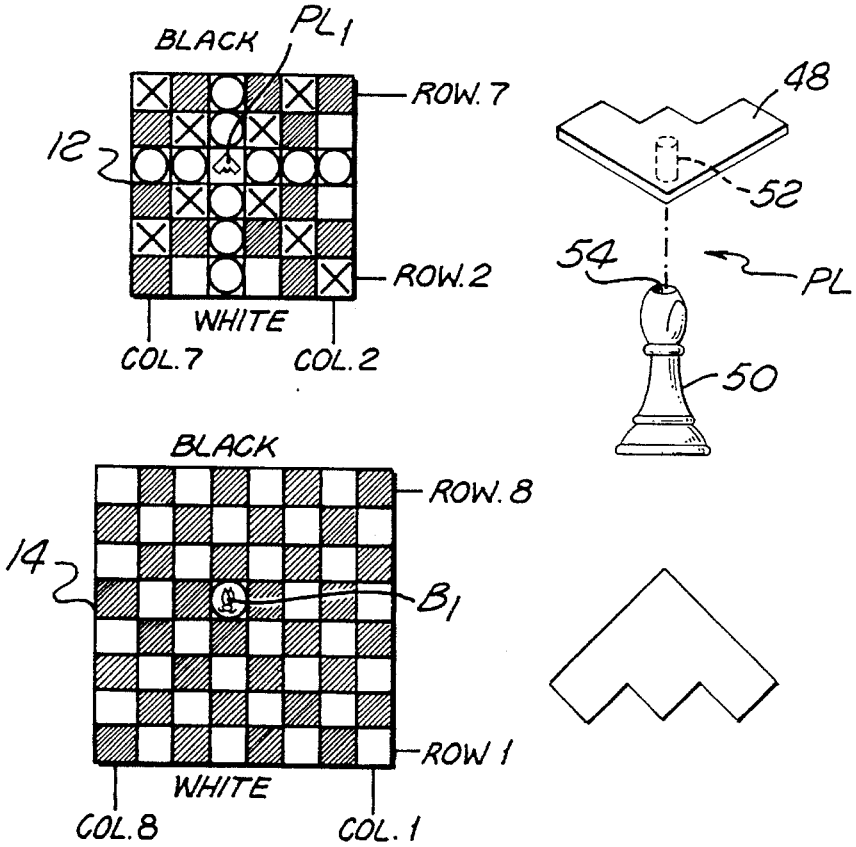
FIG. 10 is a diagrammatic view of the movements of the Plane, its representative playing piece and symbol.

As to the other optional movement of the Helicopters once they have completely cross the upper tier 12, the Helicopters can remain on the upper tier 12 and change into Planes. Referring to FIGS. 9 and 10, a Helicopter $H_3$ having moved to Row 7 on the upper tier 12 can, as the other optional movement, become a Plane $PL_3$ (not shown) on the upper tier 12.

The Plane have different movements for advancing and for capturing, as shown in FIG. 10, for example. To advance, the Planes can move diagonally for any number of squares, but only on the upper tier 12, as shown by the squares marked by an "X." To capture, the Planes can capture an opponent's piece occupying any of the squares forward, backward, right or left, by any number of squares, as marked by an "O." The Planes can also move to the lower tier 14 by capturing the opponent's pieces directly below and changing into the Bishops. For example, a Plane $PL_1$ on the upper tier 12 after capturing an opponent's piece directly below on the lower tier 14 changes into a Bishop $B_1$ on the lower tier 14. As the Bishop $B_1$, it has movements of the Bishops, as described in preceding paragraphs, and must remain on the lower tier 14 for the remainder of the game 10.

To emphasize the change of roles from the Plane to the Bishop, the Bishop shown in FIG. 10 provides an upper wing portion 48 removable from a lower portion 50 which resembles the Bishop. The upper wing portion 48 has a stem 52 extending vertically downward. The lower portion 50 defines a hole 54 which can receive the stem 52 of the upper wing portion 48. Accordingly, where the Plane is on the upper tier 12, the upper wing portion 48 is positioned on the lower portion 50 to signify the role of the Plane. Where the Plane has moved to the lower tier 14 and assumed the role of the Bishop, the upper blade portion 48 is removed to signify the role of the Bishop.

Returning to discussing the operation of the game as a whole, the goal of the game 10 in one preferred embodiment is to capture the opponent's King. The opponent is "checkmated" when its King cannot escape capture within one move. If the opponent cannot avoid moving its King into being in "check" then the game 10 terminates in a "draw" or a tie. Also, "castling" may be permitted in one preferred embodiment of the game 10. That is, the King and the Rook of the same color may both be moved simultaneously under very restricted conditions, for example, both the King and the Rook must not have been moved before, there must be no playing pieces between them, and the King cannot be moving out of check, through check, or into check.

Other embodiments of the game 10 may exist. For example, the tiers 12 and 14 may have either more or less squares S than as disclosed above. The tiers 12 and 14 may be configured differently than as disclosed above. The upper tier 12 may be supported above the lower tier 14 by other structures through means of suspension or the like. Moreover, the upper tier 12 need not be centered over the lower tier 14.

Although one preferred embodiment of the game 10 provides for the Helicopters and the Planes to become additional Pawns and additional Bishops, respectively, these former pieces may be substituted by or become other pieces, role-static or role-altering, such as, for example, the Knights, the Rooks, Tanks and/or Cannons. Perhaps, the Tanks can "plow over" the opponent's pieces by capturing more than one piece within one move under restricted conditions. Perhaps, the Cannons can only be "shot" through the air by leaping over their own pieces only and capturing the opponents pieces positioned beyond their own pieces. Furthermore, for example, when either the Tanks or the Cannons are captured, they may be demoted to Pawns, or the like.

As mentioned earlier, the role-altering pieces may also be triggered from one role to another by participating in captures (capturing and/or being captured). For example, the additional Bishops can be demoted to their original roles of the Planes if they are captured, and perhaps return to one of their starting positions on the upper tier 12, donning their upper winged portions 48. Likewise, the Planes can be demoted to their original roles of the Helicopters if they are captured, and perhaps return to one of their starting positions on the upper tier 12, donning their upper blade portions 40. Further, for example, the Helicopters can be promoted to being the Planes if the Helicopters capture the opponent's pieces.

Accordingly, from the above explanation, it may be seen that the present game 10, in its structure and/or its method of play, may be readily incorporated in various embodiments to provide a challenging, yet manageable three-dimensional board game. Consequently, it is to be understood that the scope hereof should be determined in accordance with the claims as set forth below.

What is claimed is:

1. A method of playing a three-dimensional board game, said game having multiple tiers and playing pieces positionable on said multiple tiers, said playing pieces having roles defining advancing and capturing capabilities, said method comprising the steps of:

providing a plurality of role-static pieces, each of said role-static pieces having one role and remaining in said one role for the duration of said game;

providing a plurality of role-altering pieces, each of said role-altering pieces being capable of altering between a first role and a second role, said first and second roles defining different advancing or capturing capabilities, said role-altering pieces being configured to provide a base member and a removable member, said members when separated designating said role-altering pieces being in said first role and when joined designating said role-altering pieces being in said second role;

altering between said first and second roles of said role-altering pieces when said role-altering pieces move between said tiers, said step of altering comprising a step of separating or joining said members.

2. A method in accordance with claim 1, further comprising a step of:

commencing said game by initially positioning selected role-static pieces on one of said tiers and selected role-altering pieces on another of said tiers.

3. A method in accordance with claim 2, further comprising a step of:

limiting movement capabilities of selected role-static pieces to said one tier.

4. A method in accordance with claim 2, further comprising a step of:

limiting movement capabilities of selected role-static pieces to said another tier once said role-static pieces have moved from said one tier to said another tier.

5. A method in accordance with claim 1, wherein said tiers comprise an upper tier and a lower tier, each tier being configured to provide sections, said method further comprising a step of:

limiting advancing and capturing movements of said pieces while moving between said tiers to movement between vertically aligned sections of said tiers.

6. A method in accordance with claim 3, further comprising a step of:

limiting said capturing capabilities of said role-altering pieces to movements between said tiers.

7. A method in accordance with claim 3, further comprising a step of:

defining positions on said tiers for triggering selected role-altering pieces to alter between said first and second roles.

8. A game in accordance with claim 1, wherein selected role-altering pieces alters from Helicopter roles to Pawn roles when said selected role-altering pieces move between said tiers.

9. A game in accordance with claim 1, wherein selected role-altering pieces alters from Plane roles to Pawns roles when said selected role-altering pieces move between said tiers.

10. A method in accordance with claim 1, wherein said second role comprises selected roles of said role-static pieces.

11. A method in accordance with claim 1, wherein said second role of certain role-altering pieces comprises a first role of remaining role-altering pieces.

12. A method of playing a three-dimensional board game, said game having multiple tiers and playing pieces positionable on said multiple tiers, said playing pieces having roles defining advancing and capturing capabilities, said method comprising the steps of:

providing a plurality of role-static pieces, each of said role-static pieces having one role and remaining in said one role for the duration of said game;

providing a plurality of role-altering pieces, each of said role-altering pieces being capable of altering between a first role and a second role, said first and second roles defining different capturing or advancing capabilities, said role-altering pieces being configured to provide a base member and a removable member, said members when separated designating said role-altering pieces being in said first role and when joined designating said role-altering pieces being in said second role;

altering between said first and second roles of said role-altering pieces whenever said role-altering pieces participate in a capture and said role altering pieces are in a first role, said step of altering comprising a step of separating or joining said members.

13. A method in accordance with claim 12, wherein said step of role-altering pieces alternating between said first and second roles occurs when said role-altering pieces are captured by other pieces.

14. A method in accordance with claim 12, wherein said step of role-altering pieces alternating between said first and second roles occurs when said role-altering pieces capture other pieces.

15. A game in accordance with claim 12, wherein selected role-altering pieces alters from Helicopter roles to Pawn roles when said selected role-altering pieces capture other pieces.

16. A game in accordance with claim 12, wherein selected role-altering pieces alters from Plane roles to Pawns roles when said selected role-altering pieces capture other pieces.

* * * * *